United States Patent [19]

Laine et al.

[11] Patent Number: 4,568,503

[45] Date of Patent: Feb. 4, 1986

[54] METHOD FOR THE CASTING OF CONCRETE OBJECTS

[75] Inventors: Jyrki B. Laine, Hämeenlinna; Markku K. Schuvalow; Pauli E. I. Leiviskä, both of Viiala, all of Finland

[73] Assignee: Oy Partek AB, Toijala, Finland

[21] Appl. No.: 607,181

[22] Filed: May 4, 1984

[30] Foreign Application Priority Data

May 9, 1983 [FI] Finland ..... 831605

[51] Int. Cl.[4] ..... B28B 1/08

[52] U.S. Cl. ..... 264/70; 264/33; 264/71; 425/426; 425/456

[58] Field of Search ..... 264/33, 70, 71, 72; 425/427, 429, 432, 456, 219, 64, 426

[56] References Cited

U.S. PATENT DOCUMENTS

| | | | |
|---|---|---|---|
| 3,994,639 | 11/1976 | Hewitt | 425/64 |
| 4,090,827 | 5/1978 | Attwell | 425/219 |
| 4,330,242 | 5/1982 | Putti | 425/64 |

FOREIGN PATENT DOCUMENTS

| | | | |
|---|---|---|---|
| 0679494 | 2/1964 | Canada | 264/33 |
| 2002284 | 2/1979 | United Kingdom | 425/427 |

*Primary Examiner*—Jan Silbaugh
*Assistant Examiner*—Hubert C. Lorin
*Attorney, Agent, or Firm*—Burns, Doane, Swecker & Mathis

[57] ABSTRACT

Method for the continuous slide-casting of concrete objects for compacting the high-consistency concrete mix. Repeated parallel displacements back and forth are produced in the various regional zones in the high-consistency concrete mix placed in the mould by pivoting at least two opposite walls (10) of the slide-casting mould structure in the same direction relative parallel shafts (12) substantially parallel to each other and as synchronized relative each other, back and forth. Additional walls (4) fitted into the mould and forming oblong cavities, recesses or ribs in the concrete objects are pivoted in pairs with each other in the same direction and as synchronized with each other around shafts (7) placed at the ends of the additional walls next to the outlet end of the mould, the said shafts being substantially parallel to each other. The pivot shafts (7) of the additional walls are either substantially parallel to the pivot shafts (12) of the walls forming the main part of the concrete object in the mould or substantially perpendicular to the direction of the said latter shafts.

2 Claims, 16 Drawing Figures

Fig. 7.b.

METHOD FOR THE CASTING OF CONCRETE OBJECTS

The present invention is concerned with a method in continuous slide-casting of concrete objects for compacting the high-consistency concrete mix so that repeated parallel displacements back and forth are produced in the various regional zones in the high-consistency concrete mix placed in the mould, in particular in the displacement planes in the concrete mix that are perpendicular to the longitudinal direction of the casting base and parallel to each other, by pivoting at least two opposite walls of the slide-casting mould structure in the same direction relative parallel shafts substantially parallel to each other and as synchronized relative each other, back and forth. The invention is also concerned with a slide-casting device for continuous casting and compacting of concrete objects out of high-consistency concrete mix, the said device comprising a deck plane, side walls of the mould, as well as means for feeding the high-consistency concrete mix into the mould, whereat at least two opposite walls of the slide-casting mould can be pivoted in the same direction relative shafts substantially parallel to each other and as synchronized relative each other, back and forth.

In the Finnish Patents (Patent Applications Nos. 81,3555 and 81,3556), a so-called shear-compacting method is described for the compacting of a high-consistency concrete mix when concrete objects are being cast. The compacting is achieved by in the concrete mix in the mould, in its different zones, producing parallel displacements back and forth so that two opposite walls of the casting mould are pivoted synchronously back and forth in the same direction relative each other.

The present invention is concerned with an additional application of the methods in accordance with the said patents, whereby concrete objects of different sections are obtained. The method in accordance with the invention is characterized in that additional walls fitted into the mould and forming oblong cavities, recesses or ribs in the concrete objects are pivoted in pairs with each other in the same direction and as synchronized with each other around shafts placed at the ends of the additional walls next to the outlet end of the mould, the said shafts being substantially parallel to each other. The slide-casting mould in accordance with the invention is characterized in that the additional walls fitted into the mould and forming oblong cavities, recesses or ribs in the concrete objects can be pivoted around shafts placed at the ends of the additional walls next to the outlet end of the mould, the said shafts being substantially parallel to each other. The invention can be applied to the casting of, e.g., hollow slabs, ribbed slabs, or jaw beams.

Figure 1:
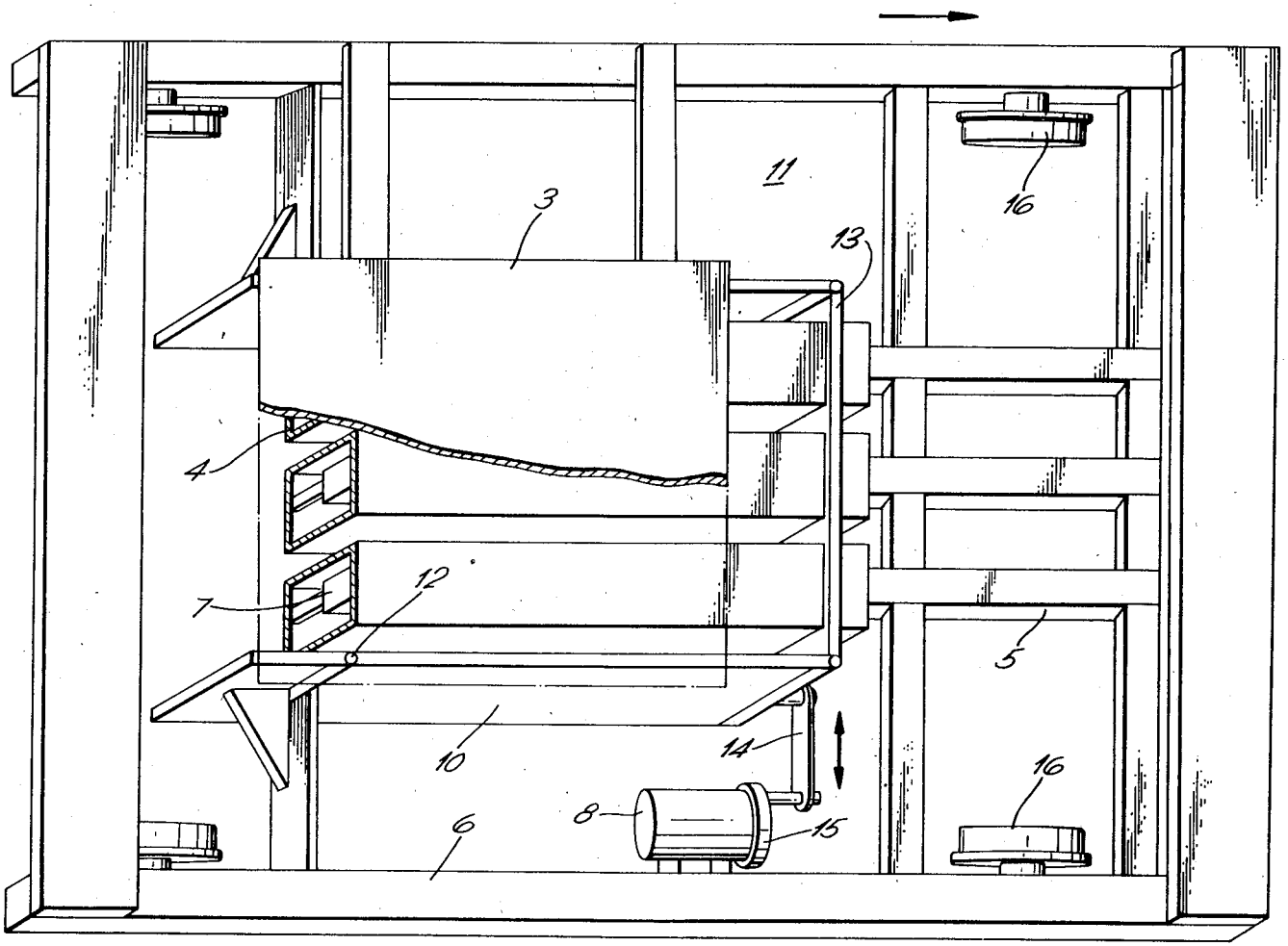
Figure 2:
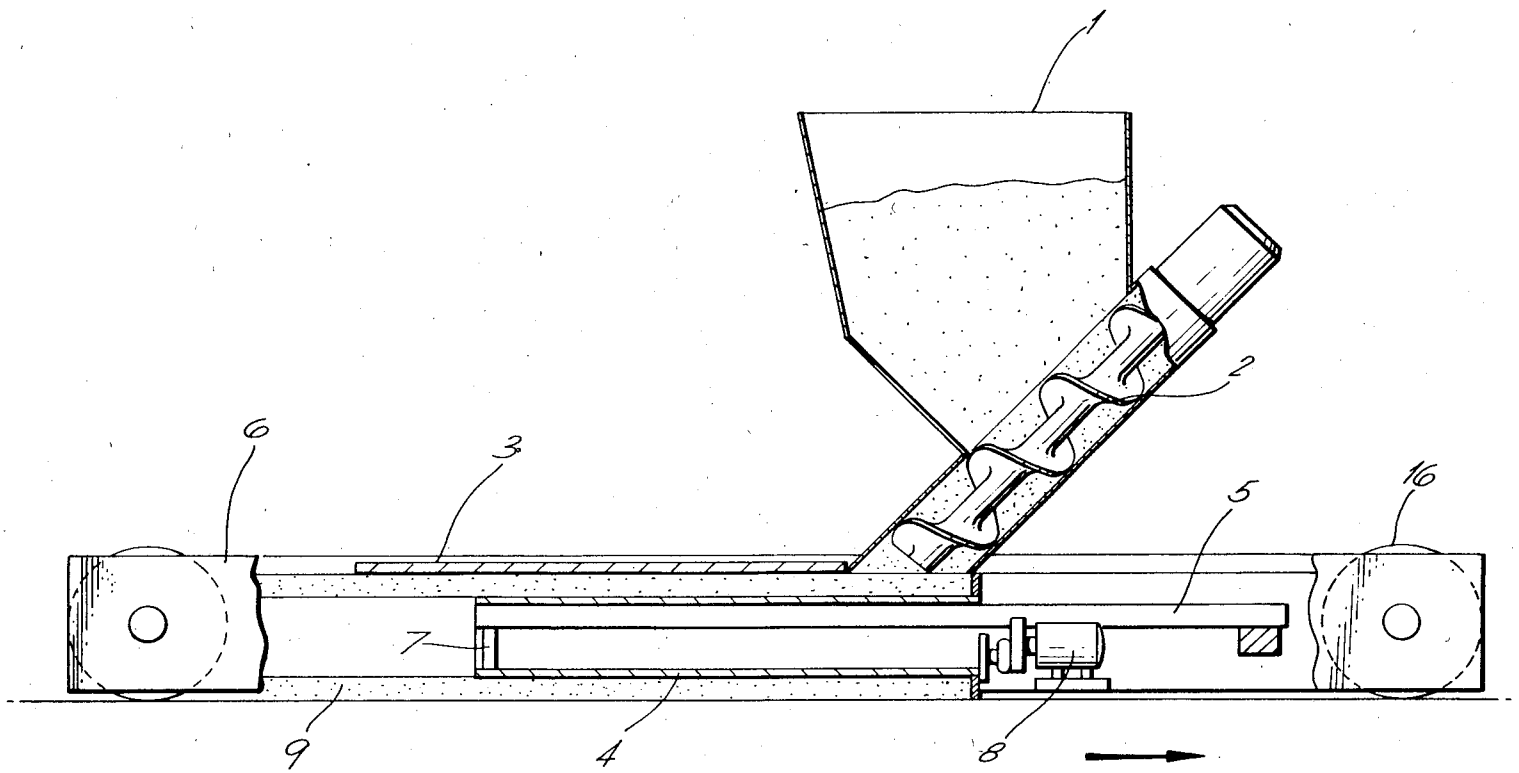
Figure 3:
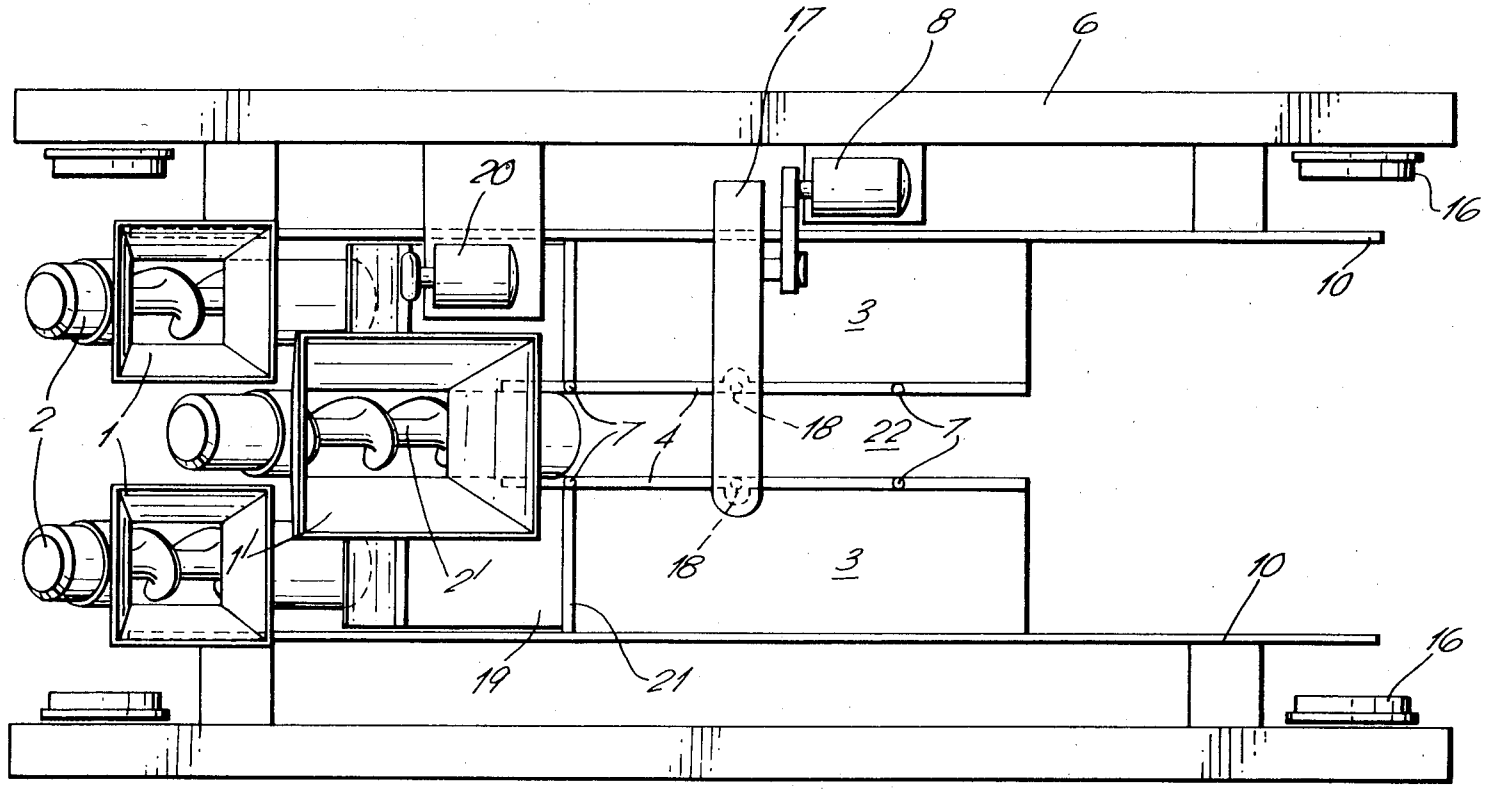
Figure 4:
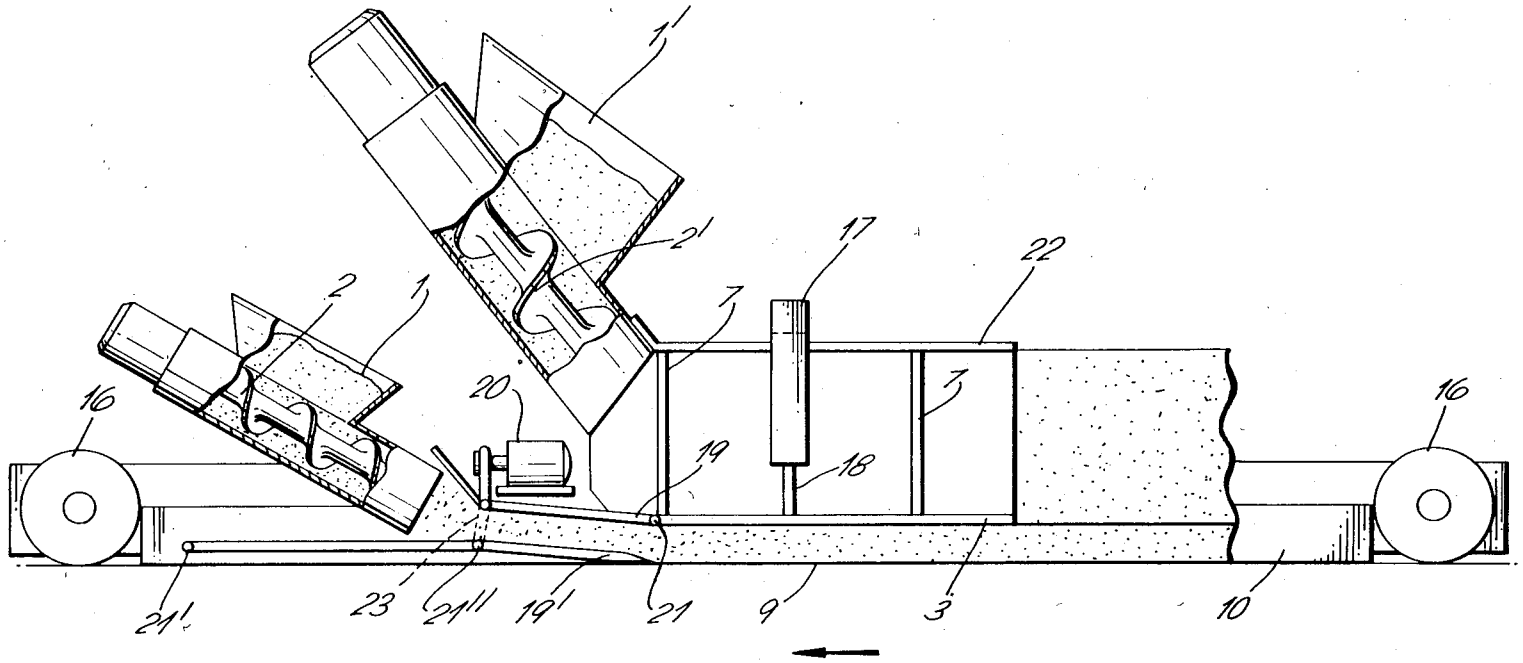
Figure 6:
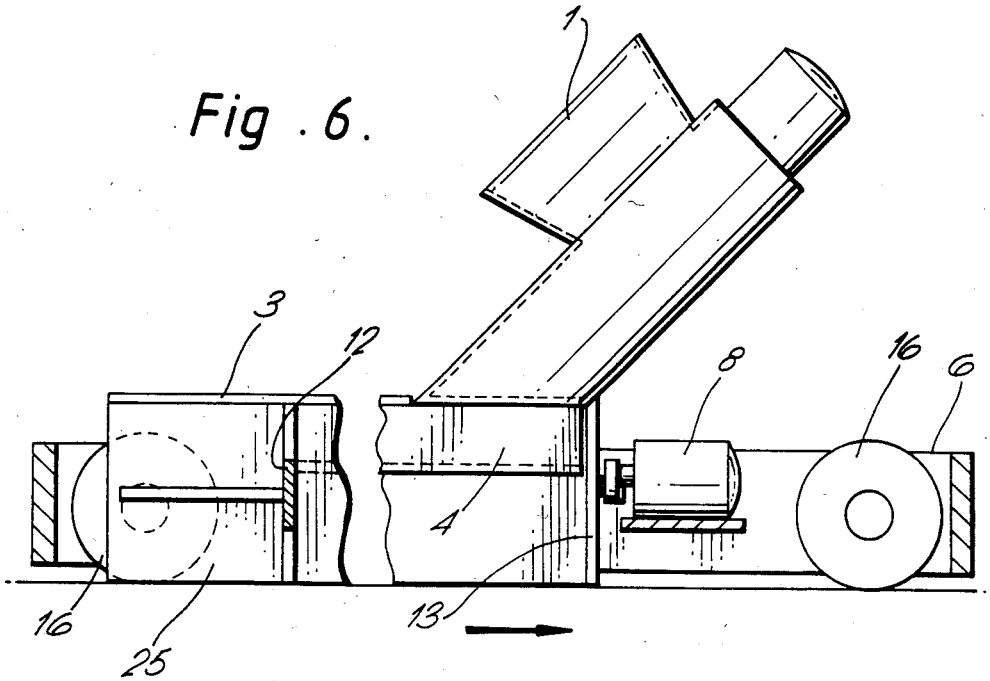
Figure 5:
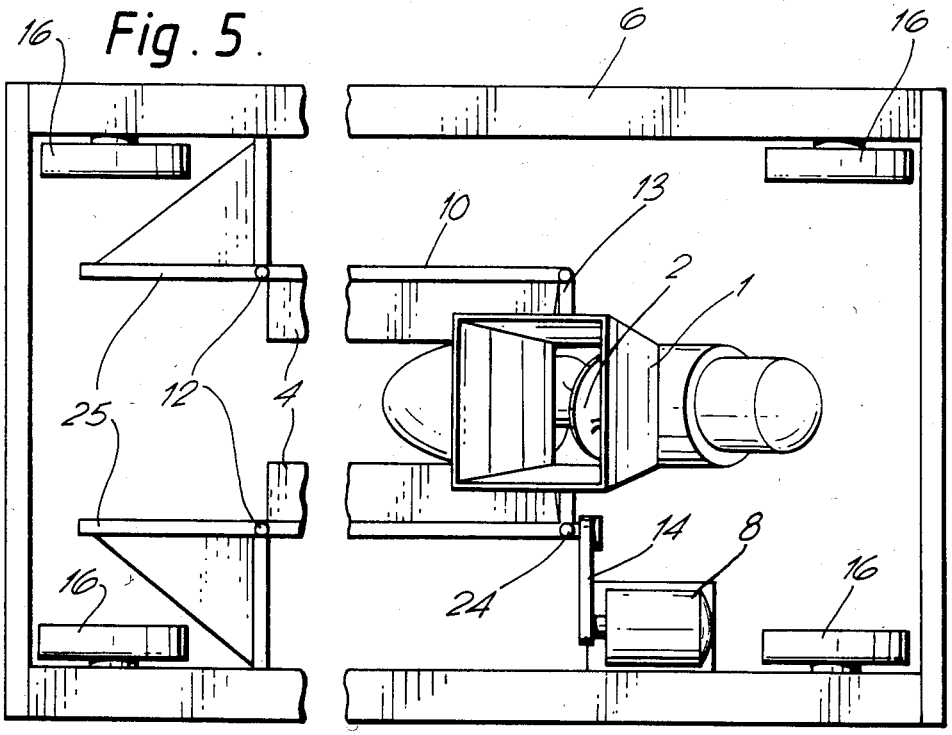
Figure 7A:
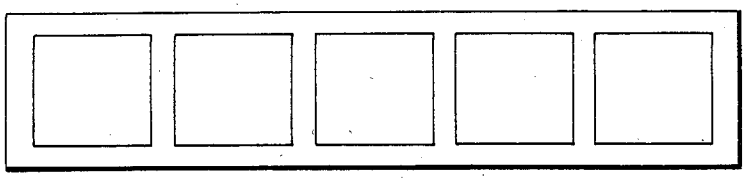
Figure 7A:
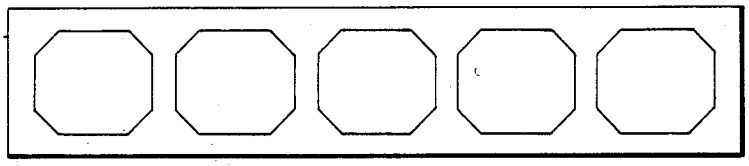
Figure 7C:
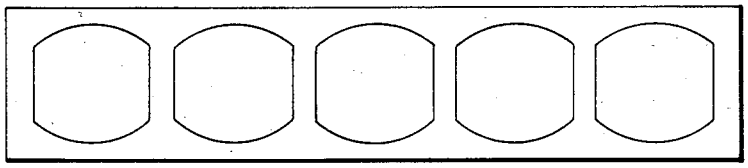
Figure 7D:
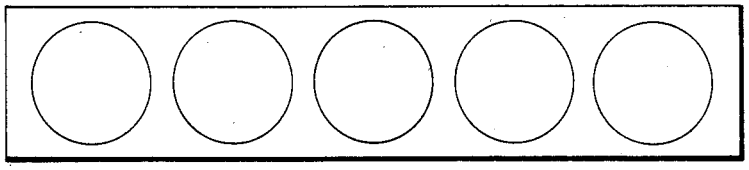
Figure 8A:
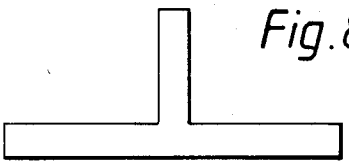
Figure 8B:
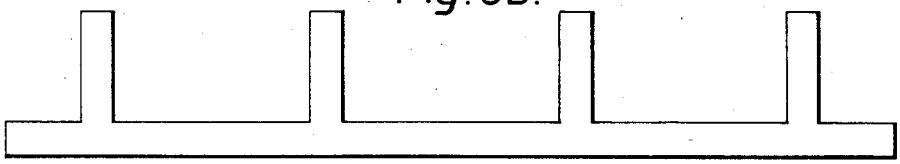
Figure 8C:
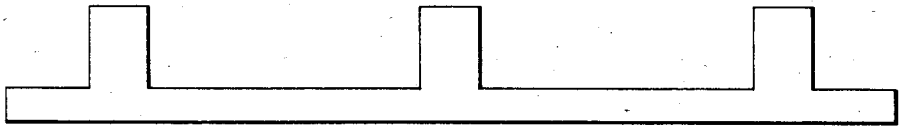

The invention and its details will be described in more detail with reference to the attached drawings, wherein FIG. 1 is a schematical axonometric view of one embodiment of a slide-casting device in accordance with the invention, FIG. 2 is a longitudinal sectional view of the slide-casting device shown in FIG. 1, FIG. 3 is a top view of a second embodiment of a slide-casting device in accordance with the invention, FIG. 4 is a longitudinal sectional view of the slide-casting device shown in FIG. 3, FIG. 5 shows a third embodiment of the slide-casting device in accordance with the invention, FIG. 6 is a longitudinal sectional view of the slide-casting device shown in FIG. 5, FIGS. *7a* to *7d* illustrate some hollow slabs manufactured by means of the method in accordance with the invention, FIGS. *8a* to *8c* illustrate some ribbed slabs manufactured by means of the method in accordance with the invention, and FIGS. *9a* to *9c* illustrate some jaw beams manufactured by means of the method in accordance with the invention.

The embodiment shown in FIGS. 1 and 2 is intended for the casting of hollow slabs. The mould comprises side plates 10 and a deck plate 3. Inside the mould, cavity mandrels 4 are fitted side by side, which are pivotable around vertical shafts 7 placed at the end placed next to the outlet end of the mould. The cavity mandrels are supported on stationary support mandrels 5 passing inside the cavity mandrels. The support mandrels are attached to the frame 6 of the machine rigidly and to the cavity mandrels by means of articulated joints 7. The side plates can be pivoted around vertical shafts 12 placed at the outlet end of the machine. The deck plate 3 is attached to the frame stationarily at the level of the top edge of the side plates. An end plate 13 placed at the initial end of the machine is attached to the side plates and to the cavity mandrels and can be displaced along with them. The frame of the machine is supported on wheels 16 on a base 9.

For the purpose of feeding the concrete mix, a feeder funnel 1 is provided above the machine, from which funnel a feeder screw 2 passes to the area 11. (For the sake of clarity, in FIG. 1 the device is illustrated without feeder funnel or feeder screw.)

An eccentric 15 fitted at the side of the machine and provided with a motor 8 is connected with the end wall 13 by the intermediate of a connecting rod 14.

When the machine is in operation, the mix is being fed out of the funnel 1 to the area 11. At the same time, the side plates 10 and the cavity mandrels 4 are moved around the vertical shafts 12 and 7 by means of the motor 8 in the transverse direction back and forth as synchronized relative each other and in the same direction. The movement is at the maximum at the end plate 13 and is reduced towards the outlet end of the mould, being at the zero at the joints 12 and 7. The machine runs, partly by the effect of the power caused by the feeder device and of the movement of the mandrels and side plates, on the base 9 as supported on the wheels 16 in the direction indicated by the arrow. In the concrete slab, cavities are formed whose shape corresponds to the rectangular section of the mandrels 4. By using mandrels of different forms, cavities of desired shape can be obtained (see FIG. 7). Shaping and number of the mandrels as well as the height and design of the side plates permit a wide selection of products. The mandrels and side walls moving back and forth cause a compacting of the high-consistency mix in the mould, also in the portions of the slab placed between the cavities. The method permits the use of pre-stressed cables and of a reinforcement mesh placed at the surface in order to reinforce the slabs.

Ribbed slabs in accordance with FIG. *8a* can be manufactured by using a device in accordance with FIGS. 3 and 4. For the formation of the bottom plate of the concrete slab, the device is provided with side plates 10 and with a deck plate 3. Ahead of the deck plate 3, there is a deck plate 19 pivoting around a horizontal shaft 21.

Underneath the deck plate 19, there is a two-part bottom plate 19'. The parts of the plate 19' are connected to each other by means of an articulated joint at 21''. The front end of the plate 19' is attached pivotably to a horizontal shaft 21'. The rear end of the plate 19' is freely supported so that its edge is placed in immediate proximity of the base 9. The plates 19 and 19' are connected with a rod 23, which is again connected with an eccentric driven by a motor 20. The feeder screw 2 feeds mix out of the feeder funnel 1 to between the plates 19 and 19'. There are two components of the device forming the bottom plate side by side. The side plates 10 of the bottom plate and the deck plate 3 are stationary.

A part forming the rib is fitted between the parts of the device that form the bottom plate. The said rib-forming part comprises two vertical side plates 4 and a stationary deck plate 22 of the rib, fitted on the top of the side plates. The bottom edges of the sides 4 extend to the level of the deck plate 3. The sides 4 consist of several parts, and there are vertical joints 7 and 18 between them. The joints 7 are stationary in their positions, whereas the joints 18 are displaceable by means of a bracket 17 attached to them. The bracket 17 is connected with an eccentric driven by the motor 8. The feeder screw 2' feeds mix out of the feeder funnel 1' to between the plates 4.

When the device is in operation, it runs on the base 9 in the direction indicated by the arrow. The plates 19 and 19' move back and forth up and down on horizontal shafts 21 and 21' by means of the motor 20. The movement of the plates 19 and 19' stops at 21, from where the the transverse movement of the vertical plates 4, forming the rib, starts, which movement is produced by the motor 8 and which movement takes place on the vertical shafts 7 and 17. From this point on, the mixes destined for the rib and for the bottom plate are also combined, forming the ribbed slab.

The slab may also be cast as provided with several ribs, whereat several parts forming the rib are used, as well as with different layer thicknesses.

Figure 9A:
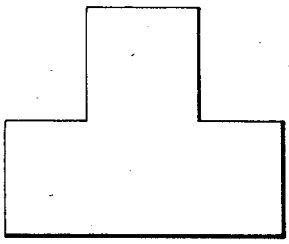
Figure 9B:
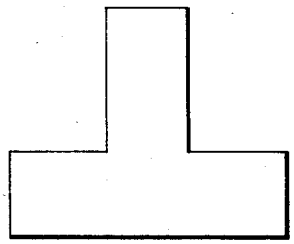
Figure 9C:
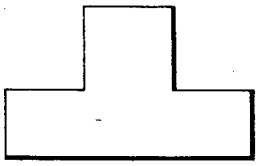

Jaw beams in accordance with FIGS. 9*a* to 9*c* may be manufactured by means of the device shown in FIGS. 5 and 6. The mould comprises a stationary deck plate 3 and side plates 10 pivoting around vertical shafts 12, as well as an end plate 13 attached to the initial end of the side plates. The mandrels 4 are attached to the side plates 10. Auxiliary sides 25 are connected with the final ends of the side plates, which said sides 25 are supported on the frame 6 of the machine. The side plates 10, the mandrels 4 attached to them, and the end plate 13 are displaced back and forth by means of an arm 14 connected with the end plate at 24, the motor 8 being connected with the said arm 14 by means of an eccentric. The movement of the sides is reduced towards the final end of the device and is at zero at the shafts 12. The mix is introduced by means of a screw 2 into the space between the mandrels 4 in the front part of the mould, from where it is spread over the entire mould.

What is claimed is:

1. A method for continuous slide-casting of concrete objects comprising compacting a high-consistency concrete mix in a slide-casting mould having a casting bed and two opposite walls so that repeated parallel displacements back and forth are produced in various regional zones in the high-consistency concrete mix placed in the mould, in particular, in displacement planes in the concrete mix that are perpendicular to the longitudinal direction of the casting base and parallel to each other, by pivoting at least the two opposite walls in the same direction relative to shafts substantially parallel to each other and synchronized relative to each other, back and forth, and further including pivoting additional pairs of walls in the same direction, said additional walls fitted into the mold and forming oblong cavities or ribs in the resulting concrete objects, and synchronizing the pivoting of the additional walls around additional shafts positioned at the ends of the additional walls adjacent an outlet end of the mold, the additional shafts being substantially parallel to each other.

2. Method as claimed in claim 1, wherein the pivot shafts of the additional walls are either substantially parallel to the pivot shafts of the walls forming the main part of the concrete object in the mould or substantially perpendicular to the direction of the said latter pivot shafts.

* * * * *